US008931302B2

(12) United States Patent
Cull et al.

(10) Patent No.: US 8,931,302 B2
(45) Date of Patent: Jan. 13, 2015

(54) HEAT EXCHANGE UNIT FOR SELF-COOLING CONTAINERS

(75) Inventors: David Cull, Bankok (TH); Mark Sillince, West Sussex (GB)

(73) Assignee: Joseph Company International, Inc., Irvine, CA (US)

( * ) Notice: Subject to any disclaimer, the term of this patent is extended or adjusted under 35 U.S.C. 154(b) by 340 days.

(21) Appl. No.: 13/642,461

(22) PCT Filed: Apr. 15, 2011

(86) PCT No.: PCT/US2011/032715

§ 371 (c)(1),
(2), (4) Date: Feb. 19, 2013

(87) PCT Pub. No.: WO2011/133428

PCT Pub. Date: Oct. 27, 2011

(65) Prior Publication Data

US 2013/0213080 A1 Aug. 22, 2013

Related U.S. Application Data

(60) Provisional application No. 61/327,516, filed on Apr. 23, 2010.

(51) Int. Cl.
*F25D 3/08* (2006.01)
*F25D 7/00* (2006.01)

(52) U.S. Cl.
CPC ..... *F25D 7/00* (2013.01); *F25D 2331/805* (2013.01)
USPC ..... 62/457.4; 62/457.9

(58) Field of Classification Search
CPC ..... F25D 7/00; F25D 2331/803; F25D 2331/805; F25D 2331/806; F25D 31/007
USPC ..... 62/457.2, 457.4, 457.5, 457.9, 293, 62/294, 371; 220/592.17, 592.23, 592.24
See application file for complete search history.

(56) References Cited

U.S. PATENT DOCUMENTS

| | | | | |
|---|---|---|---|---|
| 3,385,078 | A * | 5/1968 | Teters | 62/316 |
| 3,605,421 | A * | 9/1971 | Patrick | 62/7 |
| 4,417,667 | A | 11/1983 | Roth et al. | |
| 5,394,703 | A * | 3/1995 | Anthony | 62/5 |
| 5,427,268 | A | 6/1995 | Downing, Jr. et al. | |
| 5,606,866 | A * | 3/1997 | Anthony et al. | 62/294 |
| 5,609,038 | A * | 3/1997 | Halimi | 62/294 |
| 5,655,384 | A * | 8/1997 | Joslin, Jr. | 62/294 |
| 6,105,384 | A | 8/2000 | Joseph | |
| 6,125,649 | A | 10/2000 | Sillince | |
| 6,487,766 | B2 | 12/2002 | Sillene | |
| 6,581,401 | B1 * | 6/2003 | Anthony | 62/293 |
| 6,786,062 | B1 * | 9/2004 | Greenberg | 62/457.4 |
| 6,952,934 | B2 * | 10/2005 | Lee | 62/293 |
| 2006/0201187 | A1 * | 9/2006 | Smolko et al. | 62/315 |
| 2007/0175233 | A1 * | 8/2007 | St. James | 62/294 |
| 2009/0094994 | A1 * | 4/2009 | Willcoxen et al. | 62/62 |

OTHER PUBLICATIONS

International Search Report, PCT/US2011/032715, mailed Jun. 29, 2011.

* cited by examiner

*Primary Examiner* — Mohammad M Ali
(74) *Attorney, Agent, or Firm* — Novak Druce Connolly Bove + Quigg LLP

(57) ABSTRACT

A heat exchange unit (HEU) for positioning internally of a container for housing a food or beverage, the HEU including a metal shell having an outer surface, and a metal top section having a skirt, which fits over the outer surface of the metal shell and is permanently secured to said metal shell by an adhesive material, compressed carbon particles are disposed within said metal shell and carbon dioxide gas is adsorbed by said carbon particles and upon activation of a valve secured to said top section desorbs to cool the food or beverage.

6 Claims, 5 Drawing Sheets

HEAT EXCHANGE UNIT FOR SELF-COOLING CONTAINERS

RELATED APPLICATION

This application is based on U.S. Provisional Application No. 61/327,516 filed Apr. 23, 2010, filed as PCT/US2011/032715 with international filing date of 15 Apr. 2011 for Heat Exchange Unit for Self-Cooling Containers and claims the benefit of the filing date thereof.

BACKGROUND OF THE INVENTION

1. Field of the Invention

This invention relates generally to containers housing a pressurized medium such as self-chilling or self-heating food and beverage containers and more particularly to an improved heat exchange unit which is housed within a self-cooling container for cooling a product such as a food or beverage wherein the heat exchange unit is secured within the container and houses the pressurized medium.

2. Description of Prior Art

It has long been desirable to provide a simple, effective and safe device which may be housed within a container such as a food or beverage container for the purpose of cooling or heating a product such as food or beverage on demand. With respect to self-cooling containers, various types of devices have been developed to accomplish such desired self-cooling and various types of refrigerants have been disclosed for accomplishing such cooling. The refrigerant devices may be chemical, electrical, and may include gaseous reactions and the like. Typical of such devices are those disclosed in U.S. Pat. Nos. 2,460,765; 3,373,581; 3,636,726; 3,726,106; 4,584,848; 4,656,838; 4,784,678; 5,214,933; 5,285,812; 5,325,680; 5,331,817; 5,394,703; 5,606,866; 5,692,381; 5,692,391; 5,655,384; 6,102,108; 6,105,384; and 6,125,649.

Self-cooling devices utilized in the prior art exemplified by the above-identified patents are generally unsatisfactory. Some of the difficulties which have been encountered are that the devices generally rely on toxic or environmentally unfriendly chemicals, require very bulky pneumatic circuits and cannot economically be used in small containers such as beverage cans or food cans, are rather complex, and thus are expensive to manufacture and maintain and are ineffective. In addition, it has been found that if the pressure within the heat exchange unit increases to a predetermined amount, the portion of the heat exchange unit which carries the dispensing valve may be stressed to such a degree that it moves thereby causing the heat exchange unit to rupture and become unusable, or in the worst case, results in a total failure of the container.

Referring now more particularly to FIGS. 1, 2 and 3, there are illustrated three different embodiments of prior art containers within which there is disposed a heat exchange unit (HEU) for cooling a beverage contained within an outer container.

As shown in FIG. 1, the container (10) includes a heat exchange unit 924) disposed therein and which is surrounded by a beverage (26) to be cooled. The container includes a lid 918) which includes a conventional pull tab (12), secured to a panel (14) such that when the pull tab (12) is lifted, the panel 914) is bent into the container (10). The operation of tab (12) extending the tear panel (14) into the container (10) is well known in the art. The lid (18) conventionally includes an angular ridge (20) which is clamped to the top end (22) of the container (10). The HEU (24) houses a cooling medium which under various circumstances can increase in pressure and if the pressure becomes high enough the upper portion 928) of the HEU (24) which includes the crimp (30) that secures the valve (32) to the HEU may expand or rupture, thus creating an ineffective apparatus.

FIG. 2 is another prior art container (40) having an HEU (50) disposed internally thereof to be surrounded by a beverage (42) which is to be cooled. The top of the beverage container (44) as shown at (46) has the conventional pull tab (48) as above described. The HEU (50) includes a dispensing valve (52) secured to the cap (54) which is fitted over the top of the HEU (50) and is secured thereto. The valve (52) is carried by the skirt or flange (54) which is held in place by being crimped over the top (56) of the cap (54). The protective cover (58) is placed over the activating stem of the valve (52) to protect it from inadvertent activation. The HEU (50) and the valve (52) are secured to the bottom (62) of the can (44). Again if over pressure within, the pressurized medium contained internally of the HEU (50) occurs, rupture between the cap (54) and the body of the HEU (50) will result rendering the device unusable.

Referring now particularly to FIG. 3, there is shown still another embodiment of a prior art beverage cooling container (112) which includes an HEU (120) having internally thereof an adsorbent (138) which in the preferred embodiment is an activated carbon which receives carbon dioxide under pressure which is inserted through the valve mechanism (124) to enter into the internal part of the HEU through the opening (128) to be adsorbed by the carbon. The valve (124) is held in place by flange (122) which is crimped to the necked in top portion (132) of the HEU (120). A protective cover 150 is placed over the activating stem (130) of the valve (124) to protect it from inadvertent activation. When the activating stem (130) is depressed, the carbon dioxide is desorbed from the carbon to cool the beverage (114). The top (116) of the container (112) includes the typical pull tab (not shown) as above described. Again if the pressurized carbon dioxide contained internally of the HEU (120) over pressurizes, the necked in portion (134) of the HEU (120) will move outwardly causing a release of the valve rendering the device unusable.

What is needed, therefore, is a device which may be seated in a container and function as a HEU for cooling the contents of the container such as a food or beverage which is simple, effective and safe, even under relatively high pressure situations.

SUMMARY OF THE INVENTION

An improved HEU for use within a self-cooling container, the HEU comprising a metal shell having a closed bottom and an open top, a compacted adsorbent material disposed internally of the shell, a metal top section having a solid curl at an open upper end thereof fitted over the open end of the shell and secured to the outer surface of the shell by a metal to metal adhesive, bonding the top section to the shell.

DETAILED DESCRIPTION

Figure 4:
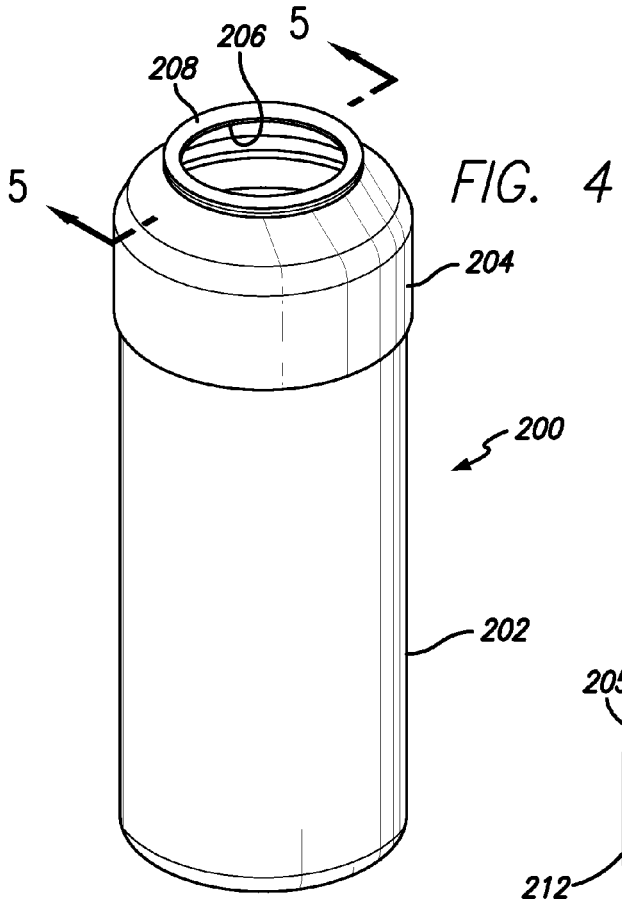
FIG. 4 is a perspective view of a completed HEU assembly constructed in accordance with the principles of the present invention.

Referring now more particularly to FIG. 4, there is illustrated a HEU (200) which has a metal shell (202) and a metal top section (204) which is secured to the top of the shell (202) as will be described in more detail below.

Figure 1:
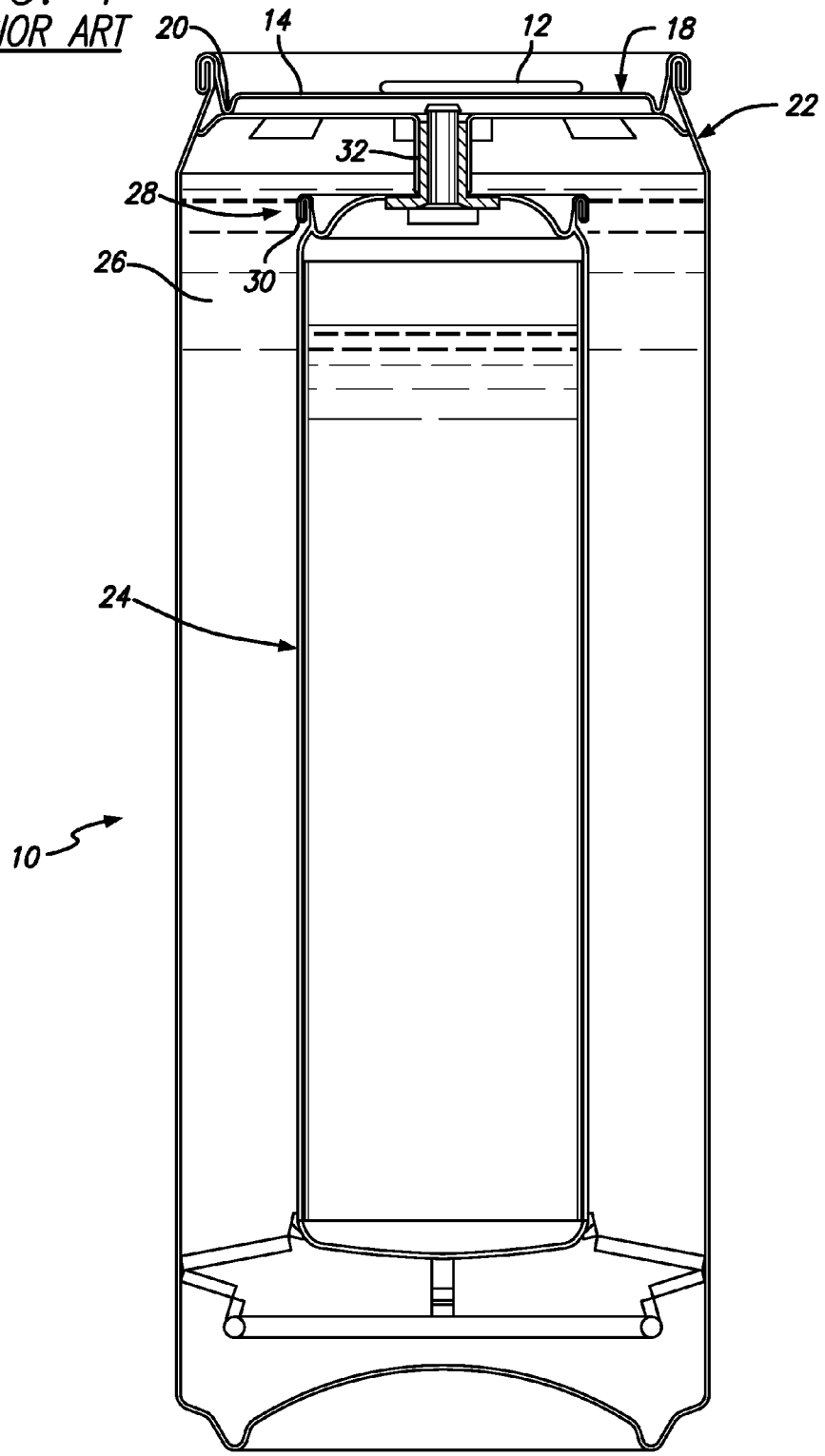
FIG. 1 PRIOR ART
FIGS. 1, 2 and 3 illustrate prior art.
Figure 2:
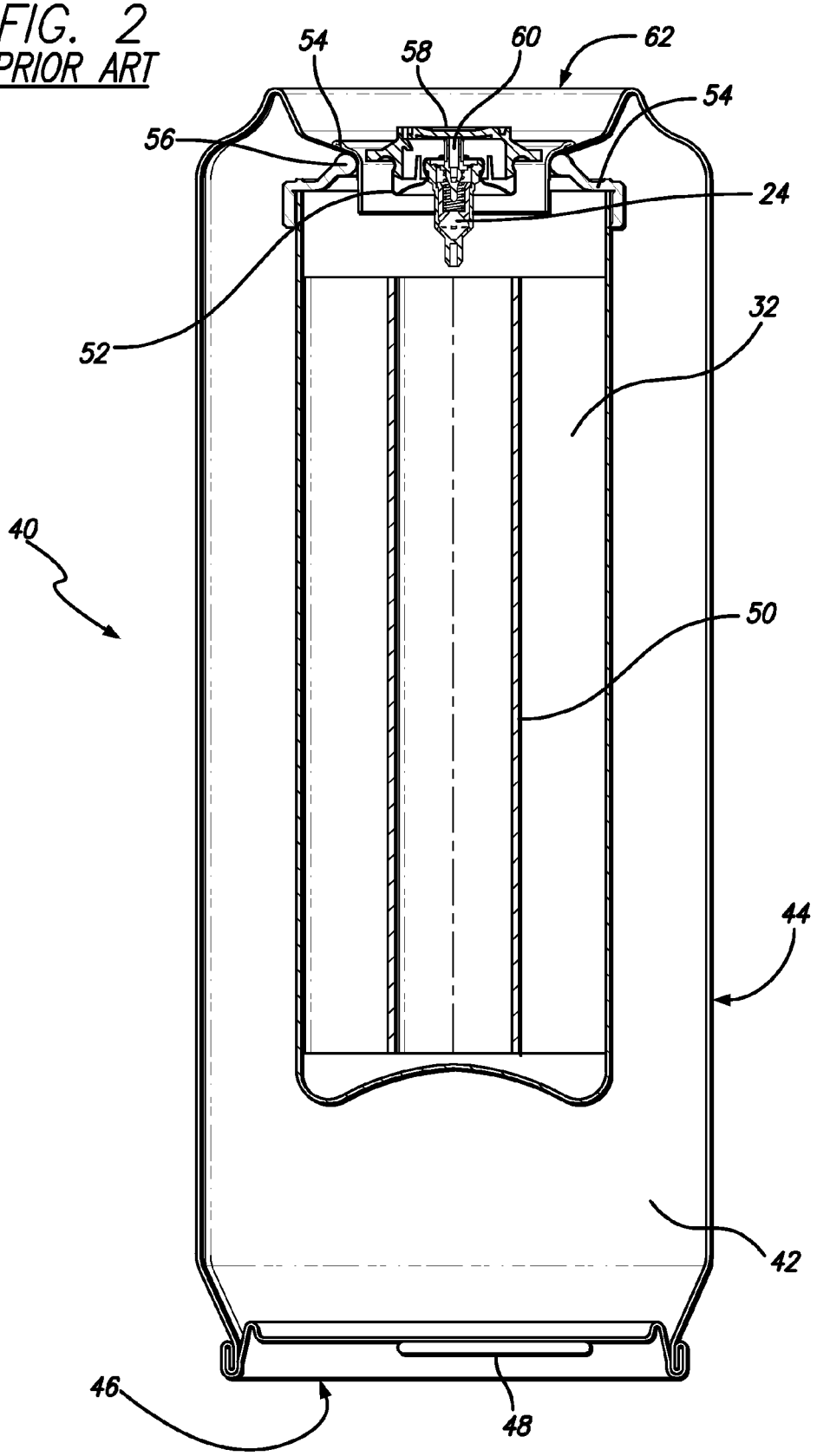
FIG. 2 PRIOR ART
Figure 3:
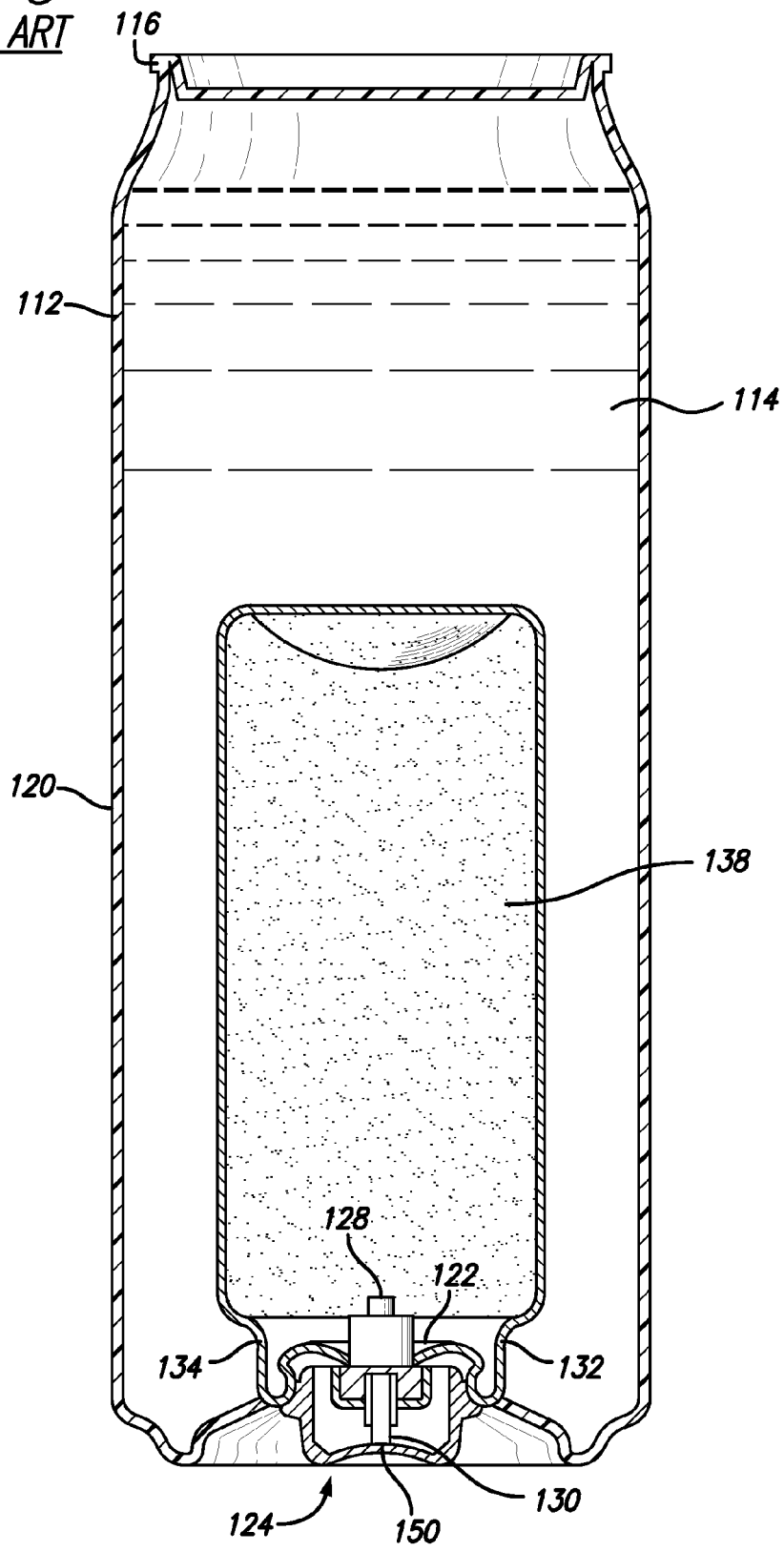
FIG. 3 PRIOR ART

The upper portion of the top section (204) of the HEU terminates in an opening (206) defined by a solid curl (208). The solid curl (208) receives a valve mechanism of the type generally above described in the prior art which is carried by a typical mounting member having a pedestal within which there is sealingly secured the appropriate dispensing valve. The valve includes the typical stem extending through the central opening in the pedestal and on a safety device that will open under excess pressure. The mounting member is inserted into the opening (206) at the top section and the outer periphery thereof and is affixed to the curl (208) by way of a crimping operation as is well known to those skilled in the art. The crimping operation not only secures the valve assembly to the HEU (200) but in addition closes and seals the open upper end of the HEU and the can to which it is affixed typically through the use of a gasket (not shown). A more detailed explanation of the valve and the crimping operation may be found in U.S. Pat. No. 6,105,384 which is incorporated herein by this reference and is generally illustrated in FIG. 3 hereof and described above.

The heat exchange unit (200) may contain a refrigerant medium which is any known to the art and which functions to conduct the heat contained within the beverage out of the beverage and into the atmosphere as the refrigerant escapes once the heat exchange unit has been activated. Various types of refrigerants have been disclosed in the prior art patents above referred to. However, the preferred refrigerant medium for the present invention is an adsorbent/desorbent mechanism preferably utilizing materials such as zeolites, cation exchange zeolites, silica gel, activated carbons and carbon molecular sieves and the like as the adsorbent. These adsorbents are capable of adsorbing under pressure a significant quantity of gas for later release. The gas adsorbed therein can be any suitable gas that is friendly to the atmosphere. Preferably the gas in accordance with the present invention comprises carbon dioxide. The carbon dioxide adsorbed in the adsorbent, preferably activated carbon particles, when released to atmospheric pressure will experience a significant drop in temperature thereby chilling the contents of the beverage which comes into contact with the outer surface of the heat exchange unit (200). A more detailed explanation of the carbon-carbon dioxide adsorbent refrigeration system is contained in U.S. Pat. No. 7,185,511 and incorporated herein by reference. Therefore a further and more detailed explanation of the carbon-carbon dioxide refrigerant system will not be provided herein.

Figure 5:
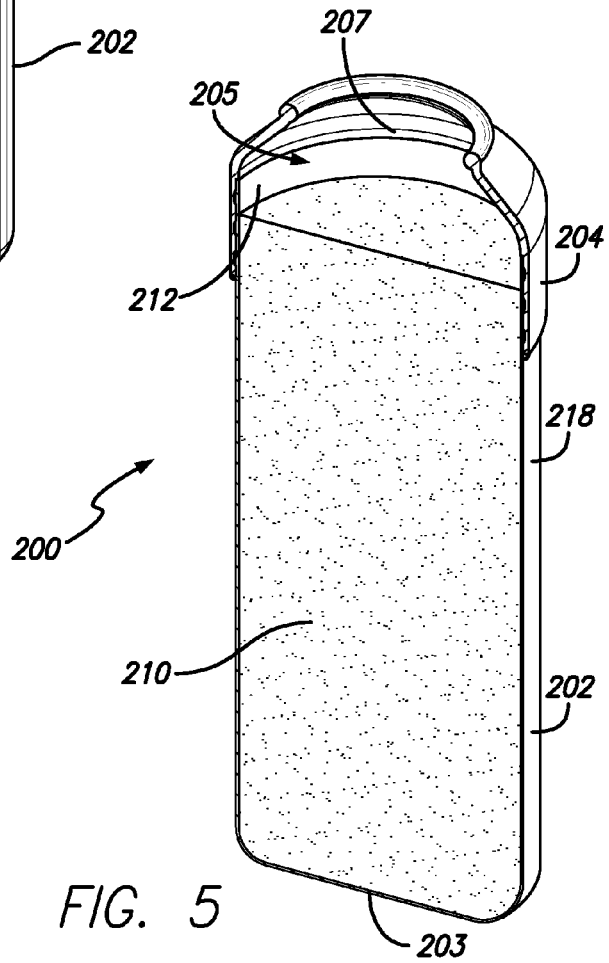
FIG. 5 is a perspective cross-sectional view of the HEU of FIG. 4, taken about the lines 5-5 thereof.

As shown in FIG. 5, the metal shell (202) has a closed bottom (203) and an open top (205) which terminates in a rim (207) and is preferably formed from impact extruded aluminum. A carbon member or plug (210) which is a highly compressed body preferably of activated carbon particles and a graphite material with a binder is preformed and is inserted and received internally of the HEU shell and extends substantially upwardly toward and adjacent the upper perimeter (212) of the HEU shell. Through the use of the open ended shell and the preformed plug (210) of carbon material, the maximum amount of adsorbent material can be contained within the HEU. Once the valve, as above described, is secured in place on the top section (204), a pressurized medium such as carbon dioxide is inserted through the valve into the interior of the HEU (200) and is adsorbed by the compressed carbon particles contained within the carbon plug (210). Upon activation of the valve, the carbon dioxide gas is desorbed from the carbon cooling the food or beverage in the container in which the HEU (200) is housed.

Figure 6:
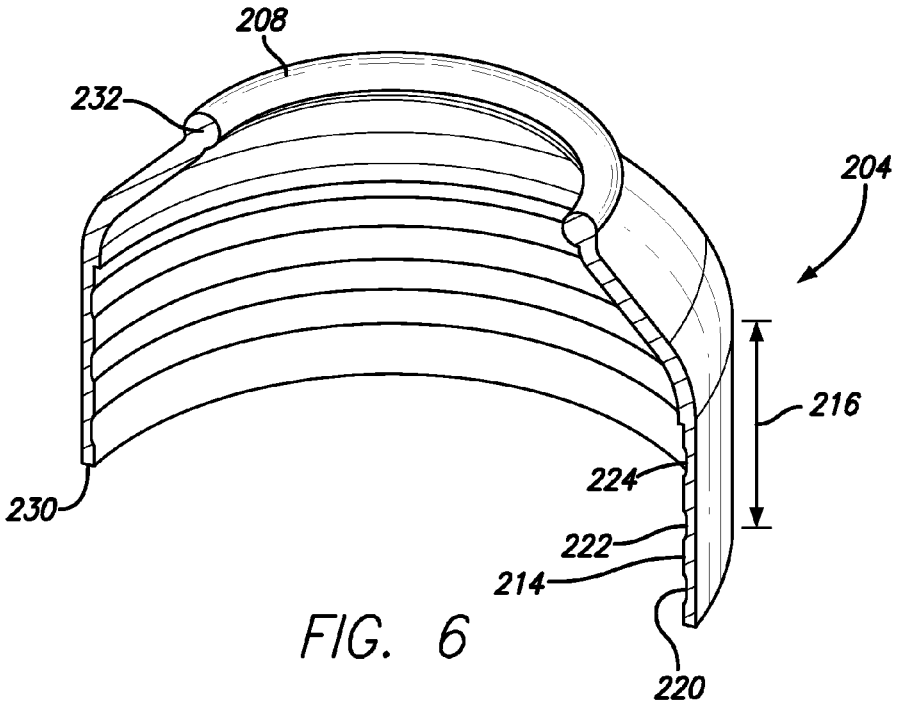
FIG. 6 is a perspective view in cross-section of the top section of the HEU as shown in FIG. 4.

As is illustrated in FIG. 6, the top section (204) of the HEU (200) is shaped so that a skirt (216) thereof fits over the outer surface (218) of the HEU shell (202). The skirt (216) of the top section (204) includes an inner surface (214) which may define a plurality of grooves such as shown at (220), (222) and (224). The inner surface (214) of the top section (204), receives an appropriate metal to metal adhesive bonding material to permanently secure the top section (204) of the HEU (200) to the HEU shell (202). It should be understood that the top section (204) inner surface may be smooth or may define one or more grooves as desired. Various food grade adhesives may be utilized so long as they permanently bond the top (214) to the shell (202) of the HEU (200) and form a secure seal to retain the pressurized carbon dioxide within the HEU. Examples of such adhesives which may be used are cross-linking adhesives such as epoxies, acrylics and the like.

The top section (204) may be machined from a blank of appropriate metal such as stainless steel. Preferably, the top section (204) may be die cast from zinc or aluminum. Whether the top section (204) is machined or die cast, or formed by other methods such as eyelet stamping or forming or spinning, it has the required strength to withstand the pressures generated by the pressurized carbon dioxide and even under high temperature conditions will not fail.

Figure 7:
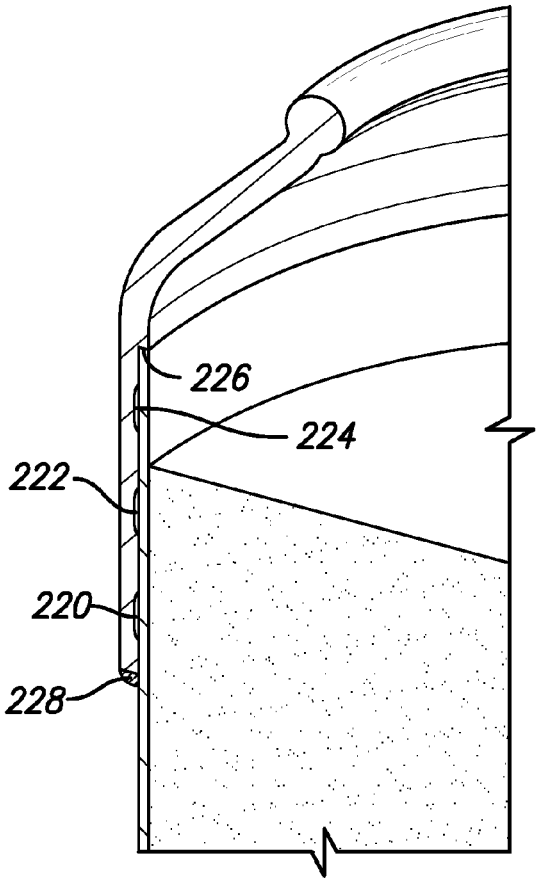
FIG. 7 is a partial cross-sectional view in perspective illustrating the attachment of the top section of the HEU to the HEU shell.

As is shown more clearly in FIG. 7, the top section (204) is formed to provide a shoulder or stop (226) which is disposed on the internal surface (214) of the top section (204) and above the grooves (220), (222) and (224) if they are provided. The shoulder (226) is disposed to mate with the rim (207) of the shell (202) of the HEU (200). After the carbon plug (210) has been positioned internally of the shell (202), the top section (204) has the appropriate adhesive applied internally thereof and is then slipped in place over the outer surface (218) of the shell (202) until the rim (207) thereof engages the shoulder (226) whereupon the top section (204) is now in place. Upon setting of the adhesive, the top section (204) is then permanently positioned and held in place and bonded to the shell (202) so that it cannot be removed. It is also contemplated that a seal such as a weld (228) will be formed between the bottom edge (230) of the top section (204) and the outer surface (218) of the shell (202). This seal or weld (228) disposes of an abrupt change in the contour of the container and precludes the possibility of contaminants becoming trapped thereby.

The open upper portion (208) of the top section (204) is formed to provide a solid curl (232) which receives the crimped flange of the outer periphery of the mounting member of the valve as above described. The top section (204) of the HEU (202) is formed, preferably from die cast zinc or aluminum it will be sufficiently strong so as not to crush or move under the pressure which may be generated by the cooling medium such as the carbon dioxide gas, that is adsorbed by the carbon plug (210).

Through the utilization of a construction such as that illustrated and described above, the maximum amount of highly compressed carbon particles can be received within the HEU shell to maximize the amount of carbon dioxide which can be adsorbed by the HEU. As is well known and described in the prior art, when the valve through which the carbon dioxide is inserted into the carbon plug (210) is activated, the adsorbed carbon dioxide then desorbs from the carbon particles and exits the HEU and in doing so removes heat from the food or beverage surrounding the external surface (218) of the HEU thereby cooling the food or beverage to the desired amount to make it more palatable. As is described in U.S. Pat. No. 6,105,384, which is incorporated by reference, a protective food grade coating may be applied to the entire external surface of the HEU to preclude any contamination of the food or beverage surrounding the HEU or the possible alteration of the taste thereof. The coating may be a food grade epoxy lacquer having a thickness of between 4 and 10 microns.

There has thus been disclosed a HEU which is constructed of materials having sufficient strength and configured to be effective and safe even under relatively high pressure situations.

What is claimed is:

1. A heat exchange unit for housing a pressurized medium for use in cooling a food or beverage disposed within a container and surrounding the heat exchange unit comprising: a metal shell having an outer surface, a closed bottom and an open upper end terminating in a rim; a die cast metal top section being substantially thicker than said metal shell and having an opening defined by a solid curl and a skirt having an inner surface and a terminus shoulder fitted over the open upper end of said metal shell and extending downwardly along the outer surface of said shell; said rim of said metal shell abutting said shoulder of said skirt inner surface so that the skirt inner surface overlaps the outer surface of said shell for a substantial distance; and a metal to metal bonding adhesive disposed between said top section inner surface and said shell outer surface to permanently secure said metal top section to said metal shell.

2. The heat exchange unit as defined in claim 1 which further includes compressed carbon particles received within said metal shell.

3. The heat exchange unit as defined in claim 2 which further includes a valve secured to said solid curl for injecting a pressurized medium into said heat exchange unit to be absorbed by said carbon and for desorbing said pressurized medium to cool said food or beverage.

4. The heat exchange unit as defined in claim 3 wherein said metal top section is die cast zinc.

5. The heat exchange unit as defined in claim 3, wherein the inner diameter of said skirt is substantially the same as the outer diameter of said metal shell but dimentioned to allow said skirt to slip fit over said metal shell during assembly.

6. The heat exchange unit as defined in claim 2 wherein said pressurized medium is carbon dioxide.

* * * * *